US007693450B2

(12) United States Patent
Kim et al.

(10) Patent No.: US 7,693,450 B2
(45) Date of Patent: Apr. 6, 2010

(54) DEVELOPING UNIT AND AN IMAGE FORMING APPARATUS INCLUDING THE DEVELOPING UNIT

(75) Inventors: Soo-yong Kim, Seoul (KR); Il-kwon Kang, Suwon-si (KR); Byeong-hwa Ahn, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 821 days.

(21) Appl. No.: 11/358,414

(22) Filed: Feb. 22, 2006

(65) Prior Publication Data

US 2007/0065176 A1 Mar. 22, 2007

(30) Foreign Application Priority Data

Sep. 22, 2005 (KR) ..... 10-2005-0088423

(51) Int. Cl.
*G03G 15/00* (2006.01)
*G03G 21/16* (2006.01)

(52) U.S. Cl. ..... 399/110; 399/111

(58) Field of Classification Search ..... 399/110, 399/167

See application file for complete search history.

(56) References Cited

U.S. PATENT DOCUMENTS 7,184,682 B2 * 2/2007 Chadani et al. ..... 399/111 X
2005/0220481 A1 * 10/2005 Yamaguchi et al. ..... 399/111

FOREIGN PATENT DOCUMENTS

| | | | |
|---|---|---|---|
| JP | 62-234176 | | 10/1987 |
| JP | 02198925 | A * | 8/1990 |
| JP | 08016070 | A * | 1/1996 |
| JP | 09244514 | A * | 9/1997 |
| JP | 11-316537 | | 11/1999 |
| JP | 2000-293086 | | 10/2000 |
| JP | 2001-255806 | | 9/2001 |
| KR | 94-5314 | | 3/1994 |

* cited by examiner

*Primary Examiner*—David M Gray
*Assistant Examiner*—Erika Villaluna
(74) *Attorney, Agent, or Firm*—Roylance, Abrams, Berdo & Goodman, L.L.P.

(57) ABSTRACT

A developing unit and an image forming apparatus having the developing unit are disclosed. The developing unit includes a developing unit main body having a supporting groove that contacts and is supported by the supporting protrusion of a frame when the developing unit is mounted on the mounting frame. A photoconductor is rotatably disposed in the developing unit main body and has ends that form a supporting shaft and are supported by a supporting unit. A driven unit is disposed in the developing unit main body and geared with the driving unit when the developing unit main body is mounted on the mounting frame. One of side surfaces of the developing unit main body includes an interference unit that interferes with the mounting frame and push the developing unit main body into engagement with the driving gear when the developing main body is mounted on the mounting frame.

18 Claims, 6 Drawing Sheets

DEVELOPING UNIT AND AN IMAGE FORMING APPARATUS INCLUDING THE DEVELOPING UNIT

CROSS-REFERENCE TO RELATED APPLICATIONS

This application claims the benefit of Korean Patent Application No. 2005-88423 filed Sep. 22, 2005, in the Korean Intellectual Property Office, the disclosure of which is incorporated herein by reference in its entirety.

BACKGROUND OF THE INVENTION

1. Field of the Invention

The present invention related to an image forming apparatus. More particularly, the invention relates to an improved developing unit and an image forming apparatus having the developing unit of the invention.

2. Description of the Related Art

An image forming apparatus is generally classified into a mono image forming apparatus and a color image forming apparatus. The mono image forming apparatus forms black and white image using a developer of only one color. The color image forming apparatus forms a color image using developers of different colors, for example, magenta, cyan, yellow and black.

An electro-photographic image forming apparatus forms an image on a printing paper according to the following step. A charging unit charges an image receiving medium, i.e., a photoconductor to have a predetermined level of an electric potential. A laser scanning unit radiates light on the photoconductor to form an electrostatic latent image. The electrostatic latent image is developed by a developer such as a toner, to form a toner image, and the toner image is transferred to a printing paper. A color image forming apparatus may include a plurality of developing units per each color and each of the developing units has its own photoconductor. Each of color toner images is formed on a corresponding photoconductor. The formed toner images of each color are transferred to an intermediate transfer medium such as a transfer belt in an overlapping manner. The overlapped color image is finally transferred to a printing paper. The color image is overlapped and transferred to a printing paper by processing through a set of predetermined operations and outputted.

Meanwhile, the plurality of developing units is an expendable supply. The developing units are attachable at a mounting frame disposed inside the image forming apparatus. The developing unit includes the photoconductor, a developer roller and a developer supply roller. The developing unit also includes drive gears at one side thereof to drive the rollers. The drive gears are in gear with driving gears positioned inside the image forming apparatus when the developing unit is attached at the mounting frame.

The developing unit is mounted at the mounting frame by a customer or a service provider. For convenience, the developing unit is mounted on the mounting frame while maintaining a predetermined gap between the developing unit and the mounting frame. A predetermined width of the gap is provided between the both ends of the developing unit and the mounting frame in a longitudinal direction of the photoconductor. The developing unit is supported by at least four points when the developing unit is completely mounted on the mounting frame in order to minimize the vibration generated from the image forming apparatus.

However, the gap may cause the coupling of the driving gears to loosen the drive gears. Therefore, less driving power is transferred to the drive gears than an ideal driving power. As a result, the photoconductor and the developer roller are driven with insufficient driving force. Furthermore, if the driving gears and the driven gears are not completely geared together, greater vibration occurs between the driving gears and the driven gears. As a result, the image quality degrades.

SUMMARY OF THE INVENTION

Accordingly, the present general inventive concept is to solve the above-mentioned problems. One aspect of the present invention is to provide an improved developing unit that is closely mounted to a driving unit of an image forming apparatus.

It is another object of the present invention to prove an image forming apparatus having an improved structure to firmly mount a developing unit to a driving unit.

In accordance with an aspect of the present invention, a developing unit is attachably mounted to a mounting frame in an image forming apparatus, where the mounting frame has a driving unit for transferring a driving force, a supporting protrusion and a supporting unit, the developing unit comprising a developing unit main body having a supporting groove that is contacted and supported by the supporting protrusion when the developing unit is mounted at the mounting frame; a photoconductor rotatably disposed in the developing unit main body and having ends each having a supporting shaft supported by the supporting unit; and an driven unit disposed in the developing unit main body and geared with the driving unit when the developing unit main body is mounted to the mounting frame, wherein one of side surfaces of the developing unit main body includes an interference unit that interferes with the mounting frame and pushes the developing unit main body to the driving gear when the developing main body is mounted on the mounting frame.

The supporting groove may be formed on both sides of a front end portion of the developing unit main body, and the photoconductor is disposed at a back end portion of the developing unit main body.

The interference unit may include a first interference protrusion formed on a front of the supporting groove to be shifted by the supporting protrusion when the developing unit main body is mounted and a second interference protrusion formed to be close to the supporting shaft.

The first and the second interference protrusions may be projected from a one side of the developing unit main body that is opposite to the driven unit as one piece.

The first interference protrusion may be projected from a guide groove that guides the supporting protrusion to the supporting groove.

A develop roller for transferring a developer to the photoconductor and a convey member for conveying the developer to the developer roller may be disposed in the developing unit main body. The driven unit may include a first driven gear transferring a driving force to the photoconductor and a second driven gear transferring a driving force to the developer roller and the conveying member.

In accordance with another aspect of the present invention, an image forming apparatus comprises a mounting frame disposed in a main body of the image forming apparatus; a driving unit disposed on the mounting frame; and a developing unit attachably mounted at the mounting frame and having a driven unit corresponding to the driving unit, wherein the developing unit includes an interference unit interfering with the mounting frame and shifting the developing unit to the driving unit when the developing unit is mounted at the mounting frame.

The mounting frame may comprise a first side wall and a second side wall disposed to be separated in parallel and corresponding to both sides of the developing unit; a guide rib corresponding to each of the first and the second side walls to guide the developing unit to be mounted and dismounted; and first and second supporting protrusions projecting respectively from the first side wall and the second side wall and supporting both sides of the front end portion of the developing unit, wherein the first and the second side walls, respectively, have a supporting unit contacting and supporting both sides of the back end portion of the developing unit.

The supporting unit may include a support slot formed in a mounting direction of the developing unit on an entrance portion of the first and the second side walls.

The mounting frame may further comprise a front wall connecting the first and the second side walls.

The developing unit may include: a developing unit main body having a supporting groove contacted and supported by the supporting protrusion when the developing unit is mounted on the mounting frame; and a photoconductor rotatably on the developing unit main body and having ends each having a supporting shaft supported by the supporting unit, wherein an interference unit includes a first interference protrusion formed in front of the supporting groove so as to contact and push the supporting protrusion when the developing unit main body is mounted, and a second interference protrusion formed closely to the supporting shaft.

The first interference protrusion may be formed with a guide groove that guides the supporting protrusion to the supporting groove.

The second interference protrusion may be externally projected longer than the first interference protrusion.

A stepped portion may be formed on one side wall facing the second interference protrusion at an entrance portion to interfere with the second interference protrusion.

A gap groove may be formed one of the side walls to maintain a predetermined gap between the one side wall and the second interference protrusion that interfer with the stepped portion.

The driving unit may include a plurality of driving gears separated from each other inside the mounting frame, and the driven unit including a plurality of driven gears to mesh with driving gears, respectively when the developing unit is mounted on the mounting frame.

These and other aspects of the invention will become apparent from the following detailed description of the invention which disclose preferred embodiments of the invention.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

Figure 1:
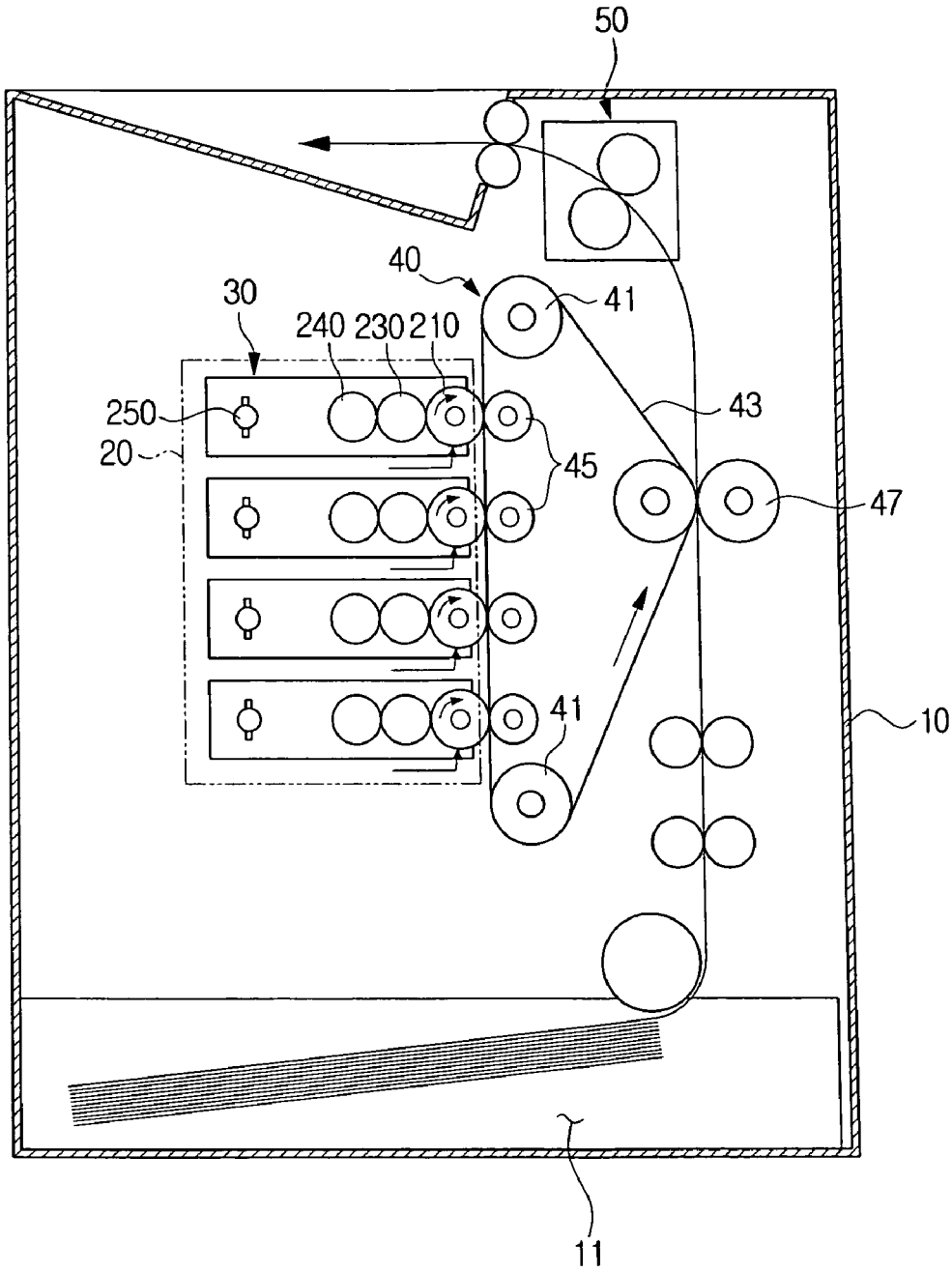
FIG. 1 is a schematic view of an image forming apparatus according to an embodiment of the present invention.

Certain embodiments of the present invention will be described in greater detail with reference to the accompanying drawings.

In the following description, same drawing reference numerals are used for the same elements even in different drawings. The matters defined in the description such as a detailed construction and elements are provided to assist in a comprehensive understanding of the invention but are intended to be limiting. Thus, it is apparent that the present invention can be carried out without those defined matters. Also, well-known functions or constructions are not described in detail since they would obscure the invention in unnecessary detail.

FIG. 1 schematically shows an image forming apparatus according to an embodiment of the present invention.

Referring to FIG. 1, the image forming apparatus includes a main body 10 of the image forming apparatus, a mounting frame 20 installed in the main body 10, developing units 30 for each color, which are attachably mounted on the mounting frame 20, a transfer unit 40 for receiving color images from the developing units 30 for each color in an overlapped manner and transferring the color image to a printing medium and a fusing unit 50.

The color developing units 30 have a same configuration except for the color of the toner.

The transfer unit 40 includes a transfer belt 43, first transfer rollers 45 and a second transfer roller 47 which are supported and driven by a plurality of support rollers 41. Each of the first transfer rollers 45 are oriented to correspond to a respective photoconductor 210 of the developing units 30. The second transfer roller 47 is rotatably disposed to be contact in the transfer belt 43 for transferring the overlapped and transferred color image on the transfer belt 43 to the printing medium.

A paper feed tray 11 is provided in the main body 10 of the image forming apparatus to supply the printing medium. Also, a laser scanning unit (not shown) is disposed in the main body 10 to form an electrophotographic latent image by irradiating a laser beam onto the photoconductor 11 of the each developing unit 30. Since the laser scanning unit, the-transfer unit 40 and the fusing unit 50 are generally included in a laser beam printing apparatus and well-known to those skilled in the art, the details thereof are omitted.

Figure 2:
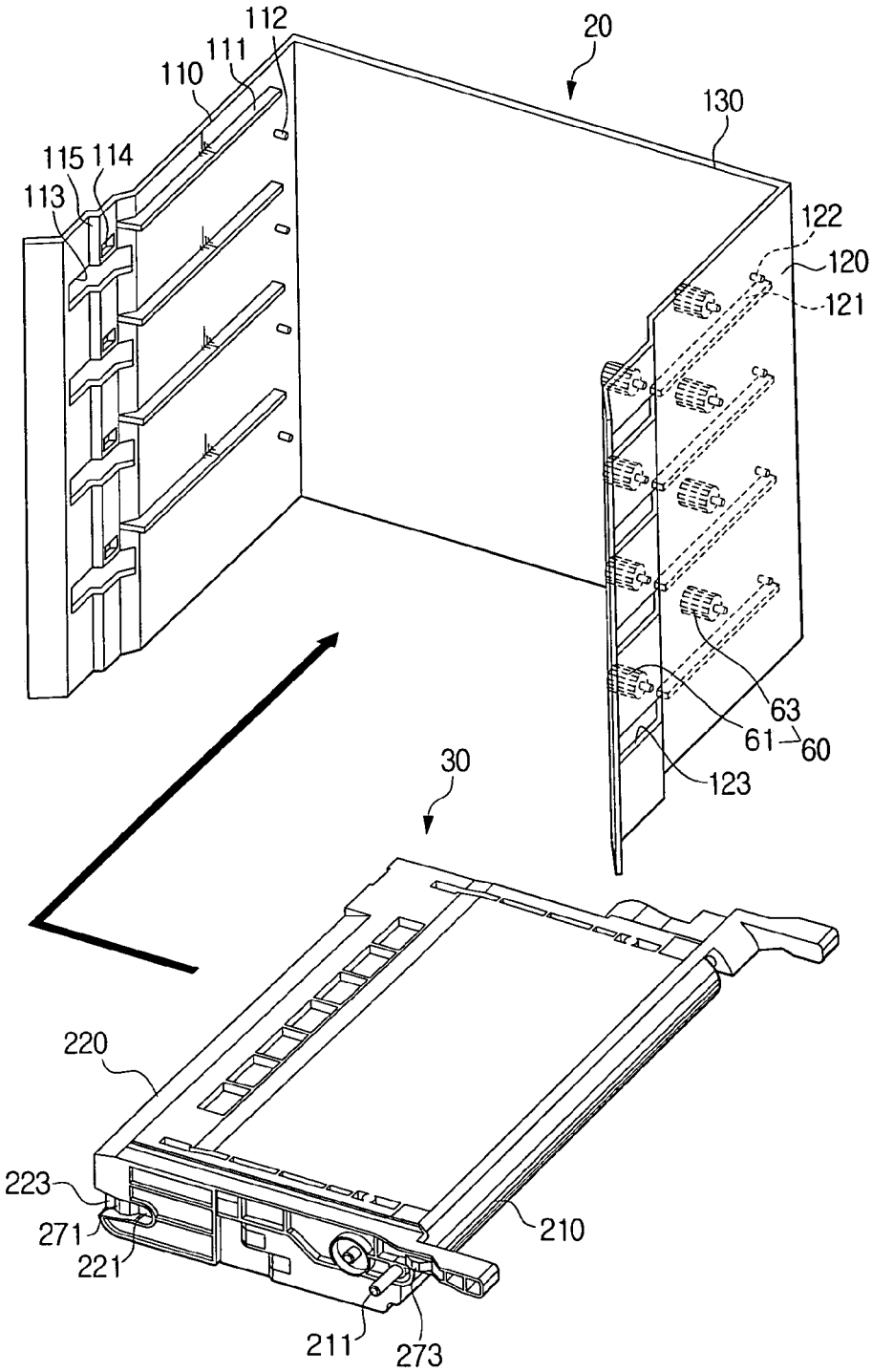
FIG. 2 is a exploded perspective view of a developing unit and a mounting frame shown in FIG. 1.

The developing units 30 may be orderly disposed to form color images of yellow Y, magenta M, cyan C and black K in a conveying direction with respect to the direction of movement of the transfer belt 43. As shown in FIG. 2, the mounting frame 20 includes a first side wall 110 and a second side wall 120, which are separated from one another and face each other. A front wall 130 extends between the side wall 110 and side wall 120. The side walls 110 and 120 and the front wall 130 are made of a metal and may be joined with screws. Guide ribs 111 and 121 are disposed on the facing surfaces of the first and the second side walls 110 and 120, respectively, within a predetermined space between the top to the bottom of the mounting frame 20. The guide ribs 111 and 121 are disposed to form a plurality of stories or levels corresponding to the number of the developing units 30. Also, support protrusions 112 and 122 are disposed at corresponding positions of the first and the second side walls 110 and 120, respectively. The support protrusions 112 and 122 contact and support both front end sides of the developing units 30. Accordingly, the support protrusions 112 and 122 are disposed to be close to the front wall 130.

Supporting units 113 and 123 are disposed on the first and the second side walls 110 and 120, respectively. The supporting units 113 and 123 support both back end sides of the developing units 30. It is preferable that the supporting units 113 and 123 are supporting slots formed in side walls 110 and 120 to receive supporting shafts 211 disposed at both end sides of the photoconductors 210. Hereinafter, the supporting units 113 are referred to as the supporting slots. The supporting slots 113 are formed to have a predetermined length at an entrance portion of the side walls 110 and 120 opposite the front wall 130.

Gap grooves 114 are formed at the entrance portion of one of the side walls 110 and 120. In the present embodiment, the gap grooves 114 are formed in the first side wall 110 adjacent the supporting slot 113. The gap groves 114 are formed at the entrance portion of the side wall 110 to be adjacent to the supporting slots 113 and to have a predetermined depth from an inner surface of the side wall 110 and facing the side surface of the developing unit 30 in an outward direction. Details of the gap grooves 114 will be described in later.

A stepped portion 115 is formed at the entrance portion of the side wall 110 where the gap grooves 114 are formed for interfering with the developing units 30 when the developing units 30 are mounted in the frame 20. The stepped portion 115 is formed to define stepped surfaces becoming further apart from the facing side wall 120 in a direction to the entrance. That is, the stepped portion closer to the entrance is spaced a greater distance from the facing side wall 120 than the stepped potion farthest from the entrance. The entrance of the mounting frame 20 is defined as the open end opposite the front wall 130. The stepped portion 115 may have a plurality of stepped surfaces in a mounting direction of the developing unit 30. As shown in FIG. 2, the entrance is wider at the mouth and converges toward the side walls 110, 120.

Figure 3:
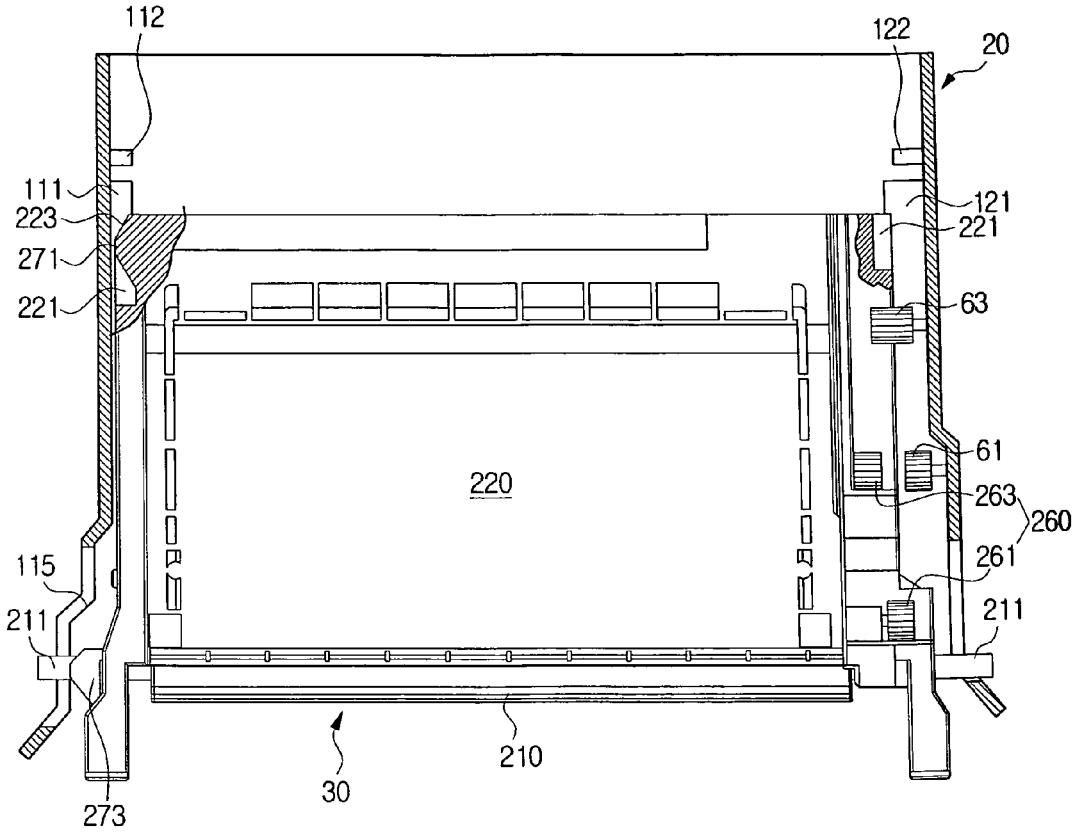
FIGS. 3 through 5 are top plan views showing the mounting of the developing unit at the mounting frame shown in FIG. 2.
Figure 4:
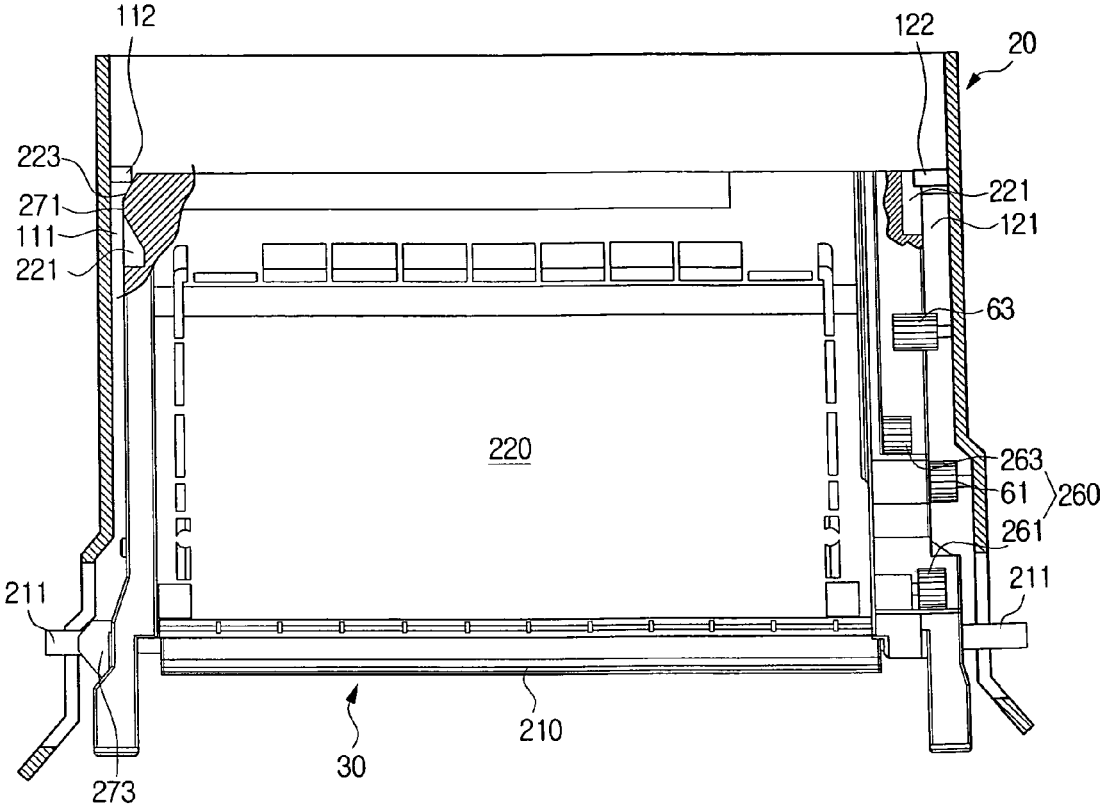
Figure 5:
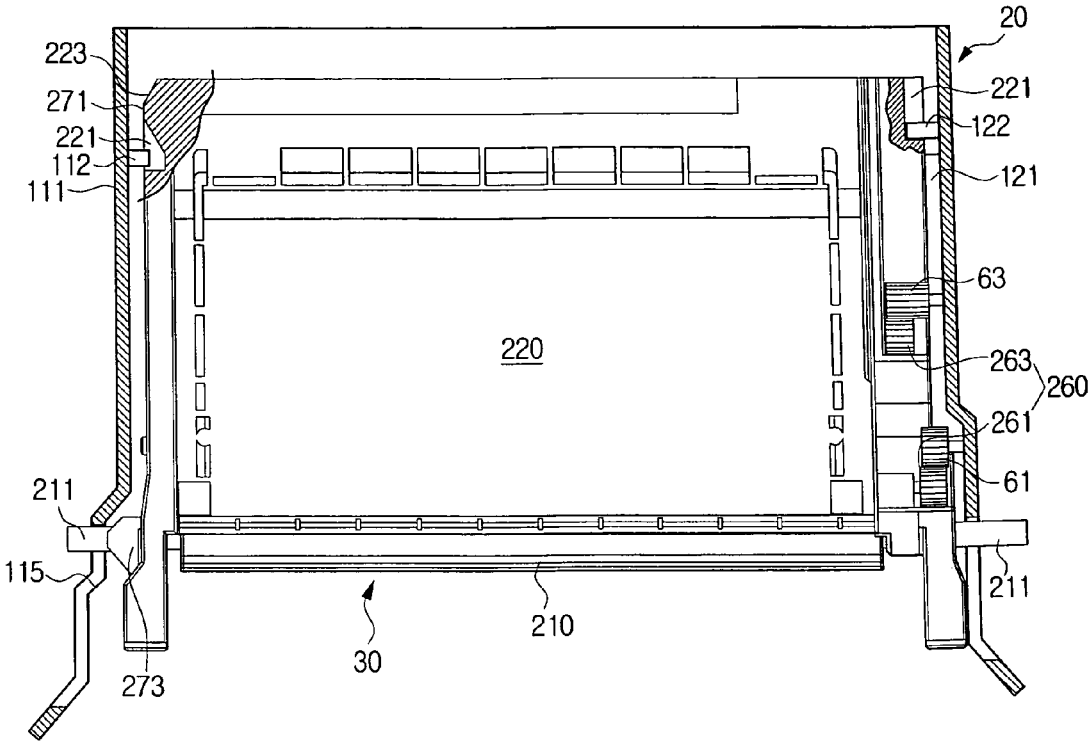

A driving unit 60 is disposed on the second side wall 120 facing the first side wall 110 as shown in FIGS. 2, 3 and 4. The driving unit 60 also faces the gap grooves 114 and the stepped portion 115 in side wall 110. The driving unit 60 includes first driving gears 61 and second driving gears 63 which are rotated by a driving force from a driving source installed on the main body 10 of the image forming apparatus. The driving gears 61 and 63 are rotatably mounted on the side wall 120 and project from the inner surface of the second side wall 120 to different distances. The driving unit 60 of the mounting frame 20 is positioned to mesh with the gears 261, 263 of a driven unit 260 on each of the developing units 30 to transfer the driving force from the driving unit 60 to the driven unit 260 as shown in FIGS. 3-5.

In order to provide a predetermined gap between the side walls 110 and 120 and the developing unit 30 when the developing units 30 are mounted on the mount frames 20, the side walls 110 and 120 are disposed to have sufficient space between them. Therefore, the supporting protrusions 112 and 122 of the side walls 110 and 120, respectively, support two positions of the front end of the developing units 30 when the developing units 30 are mounted on the mounting frame 20. The back end of the developing units 30 are supported by inserting the supporting shafts 211 of the photoconductors 210 into the supporting slots 113 and 123. As shown in FIGS. 2 and 3, the shafts 211 of the photoconductor 210 extend beyond the side walls of the developing unit 30. The developing units 30 are joined with the side walls 110 and 120 with a sufficient margin. The developing units 30 are supported at the front end by the supporting protrusions 112 and 122 and at the rear end by the shafts 211 being received in the supporting slots 113 and 123. Therefore, each of the developing units 30 is supported by four points.

Each of the developing units 30 includes a developing unit main body 220 rotatably supporting the photoconductor 210. As shown in FIG. 1, the developing unit 30 includes a developer roller 230 and a conveying member 240 installed inside the developing unit main body 220.

The photoconductor 210 is positioned with a portion being projected to an exterior of the main body 220. The supporting shaft 211 disposed at both ends of the photoconductor 210 project outwardly to both sides of the back end of the main body 220 to a predetermined length. The supporting shafts 211 are inserted into and rotatably supported by the supporting slots.

The developer roller 230 supplies a developer such as a toner that is stored in the main body 220 to the photoconductor 210 as shown in FIG. 1. The conveyor member 240 is rotatably disposed to supply the toner stored in the main body 220 to the developer roller. The developing unit 30 also includes an agitator 250 for agitating the toner also shown in FIG. 1. The photoconductor 210 is independently driven. The developer roller 230, the convey member 240 and the agitator 250 are driven by a driving force that is different from the driving source of the photoconductor 210. In order to drive such components, as shown in FIG. 3, the developing unit 30 includes a driven unit 260 for driving other components 230, 240 and 250 which receives the driving force from the driving unit 60. The driven unit 260 includes a first driven gear 261 that meshes with the first driving gear 61 and a second driven gear 263 that meshes with the second driving gear 63. The first driven gear 261 may be mounted on the same shaft as the supporting shaft 211 of the photoconductor 210. The first driven gear 261 is disposed at the back end of the developing unit main body 220 and the second driven geared 263 is disposed at about the middle of the developing unit main body 220 in the mounting direction as shown in FIG. 3. The first drive gear 261 is disposed to project outwardly a distance greater than the second driven gear 263 from the side surface of the developing unit main body 220. Therefore, during the insertion of the developing unit into the frame 20, the second driven gear 263 does not interfer with the first driving gear 61 and can mesh with the second driving gear 63.

Each of the developing units 30 include interference members that push the developing units 30 into engagement with the driving gears 61 and 63 when the developing units 30 are mounted on the mounting frames 20 in order to maximize an amount of meshing between the driven gears 261 and 263 and the driving gears 61 and 63. One side of the developing unit main body 220 that faces the first side wall 110 of the mounting frame 20 includes the interference unit for pushing the developing unit main body 220 toward the second side wall 120 when the developing unit main body 220 is mounted to the mounting frame 20.

The interference unit includes a first interference protrusion 271 projecting from a front end side surface of the developing unit main body 220 and a second interference protrusion 273 projecting from a back end side surface of the developing unit main body 220.

The first interference protrusion 271 is positioned at a leading end of the developing unit main body 220 where it interferes with the supporting protrusion 112 when the developing unit main body 220 is mounted on the frame 20. A supporting groove 221 shown in FIG. 2 is formed on the leading side surface of the developing unit main body 220 surrounding protrusion 271 to receive the supporting protrusion 112 on the side wall 110 of the frame 20 to support the developing unit 30. The first interference protrusion 271 is formed in a guide groove 223 for guiding the supporting protrusion 112 into the supporting groove 221. Therefore, the first interference protrusion 271 projects outwardly a distance greater than the depth of the supporting groove 221 and less than or the same as the side surface of the developing unit main body 220. The first interference protrusion 271 is positioned at a front portion of the supporting groove 221 in the mounting direction so that the supporting protrusion 112 of the frame 20 contacts the first interference protrusion 271 before the supporting protrusion 112 is inserted into the supporting groove 221.

The second interference protrusion 273 is formed close to the supporting shaft 211 at a rear end of the developing unit 30. The second interference protrusion 273 projects outwardly further than the first interference protrusion 271 and is formed at the back end of the developing unit main body 220. The second interference protrusion 273 interferes with the stepped portion 115 of the side wall 110 to guide the developing main body 220 toward the second side wall 120. The gap groove 114 formed on the side wall 110 prevents the second interference protrusion 273 and the first side wall 110 from contacting or interfering after the second interference protrusion 273 passes the stepped portion 115.

Hereinafter, operations of mounting the developing unit 30 in the image forming apparatus according to the present invention will be described.

The developing unit 30 is first inserted into the mounting frame 20 along the guide ribs 111 and 121 as shown in FIG. 3. Then, the developing unit 30 is smoothly inserted into the mounting frame 20 with a predetermined gap being maintained before the developing unit 30 is completely inserted into the mounting frame 20. The supporting protrusion 112 and the first interference protrusion define cam surfaces to move the front end of the developing unit toward the second wall 120. The stepped portion 115 and the second protrusion 273 define cam surfaces to move the rear end of the developing unit 30 toward the second side wall 120.

Figure 6:
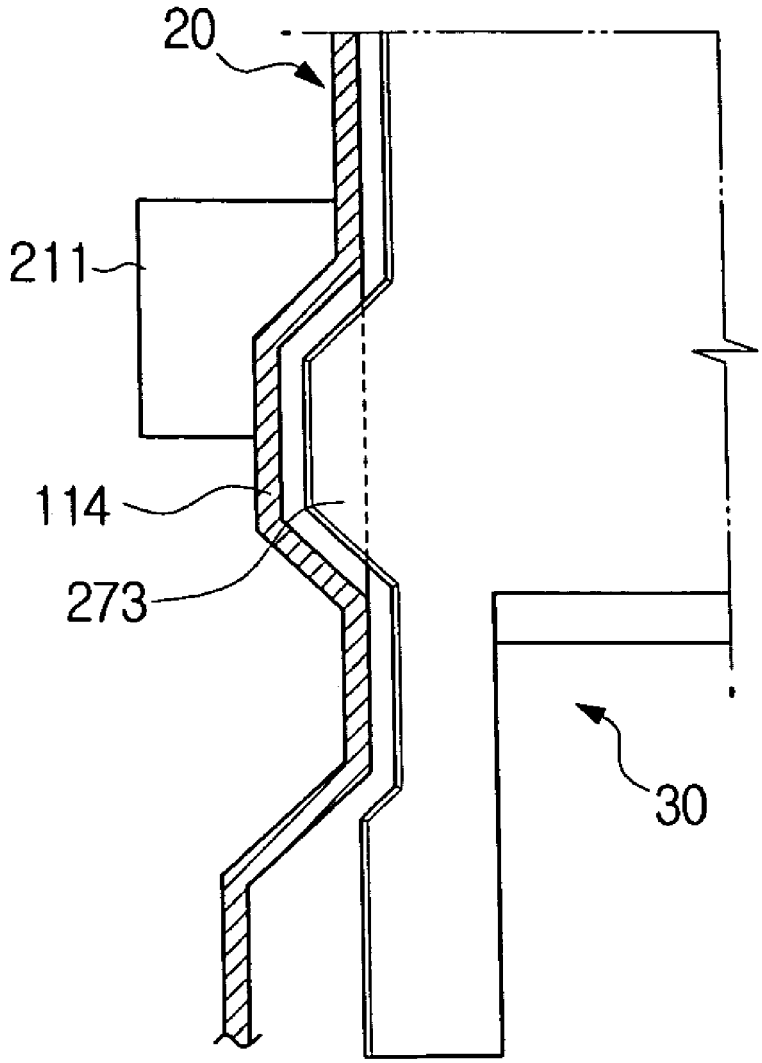
FIG. 6 is a partial cross-sectional view for describing that a second interference protrusion is supported by a gap groove after completely mounting the developing unit on the mounting frame shown in FIG. 2.

When the developing unit 30 is almost completely inserted into the mounting frame 20, the first interference protrusion 271 contacts the supporting protrusion 112 while the guide groove 223 guides the supporting protrusion 112 as shown in FIG. 4. Then, the developing unit 30 is pushed by the first interference protrusion 271 toward the second side wall 120. At the same time, the second interference protrusion 273 interferes with the stepped portion 115 and pushes the developing unit 30 toward the second wall 120. Accordingly, the developing unit 30 moves toward the second side wall 120 right before the developing unit 30 is completely mounted at the mounting frame 20. As shown in FIG. 5, since the developing unit 30 is completely mounted on the mounting frame 20 with the developing unit 30 being moved toward the second side wall 120, the meshing of driving gears 61 and 63 and the driven gears 261 and 263 is naturally increased. The supporting protrusion 112 is inserted into the supporting groove 221 to support the developing unit 30. Also, the second interference protrusion 273, as shown in FIG. 6, is inserted into the gap groove 114 to prevent the developing unit 30 from contacting to the first side wall 110. The supporting shafts 211 are rotatably supported by the support slots 113, 123. Since the first and the second interference protrusion 271 and 273 are formed on one side surface of the developing unit main body 220, the opposite side surface of the developing unit main body 220 is naturally supported by the supporting protrusion 122 and the support slot 123.

As described above, the developing unit is maximally pushed by the interference unit in an orthogonal direction from the mounting direction, so that the driving gears mesh with the driven gears, right before the developing unit is completely mounted at the mounting frame in the image forming apparatus according to the present invention. Therefore, the amount of meshing with the driving gear and the driven gear increase with a predetermined gap between the developing unit and the mounting frame being maintained.

Accordingly, vibration generated from the driving gear and the driven gear can be minimized, and the jitter caused by the vibration can be prevented or minimized. This results in improved image quality.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A developing unit for mounting to a mounting frame in an image forming apparatus, where the mounting frame has a driving unit for transferring a driving force to the developing unit, a supporting protrusion and a supporting unit for supporting the developing unit, the developing unit comprising:

a developing unit main body having a front side and an outer side surface with a supporting groove for contacting the supporting protrusion when the developing unit is mounted on the mounting frame to support the main body, wherein the supporting groove is formed on both outer side surfaces of a front end portion of the developing unit main body, and the photoconductor is disposed at a back end portion of the developing unit main body;

the photoconductor rotatably disposed in the developing unit main body and having a supporting shaft with opposite ends supported by the supporting unit; and a driven unit disposed in the developing unit main body and meshing with the driving unit when the developing unit main body is mounted to the mounting frame, wherein one of side surfaces of the developing unit main body includes an interference unit that interferes with the mounting frame and to push the developing unit main body in a transverse direction with respect to a mounting direction into engagement with the driving unit when the developing main body is mounted on the mounting frame.

2. The developing unit of claim 1, wherein the interference unit comprises a first interference protrusion at a front end of the developing unit and in front of the supporting groove to contact the supporting protrusion when the developing unit main body is mounted, and a second interference protrusion is provided close to the supporting shaft to shift the developing unit toward the driving gear when the developing unit is mounted in the mounting frame.

3. The developing unit of claim 2, wherein the first and the second interference protrusions project outwardly from one side of the developing unit main body that is opposite to the driven unit.

4. The developing unit of claim 2, wherein the first interference protrusion projects from a guide groove that guides the supporting protrusion to the supporting groove.

5. The developing unit of claim 1, wherein a developing roller for transferring a developer to the photoconductor and a conveying member for conveying the developer to the developer roller are disposed in the developing unit main body, and the driven unit includes a first driven gear for transferring a driving force to the photoconductor and a second driven gear for transferring a driving force to the developer roller and the conveying member.

6. An image forming apparatus comprising:

a mounting frame disposed in a main body of the image forming apparatus, the mounting frame comprising a first side wall and a second side wall spaced apart and parallel to each other to define two sides of the mounting frame for a developing unit, a guide rib on each of the first and the second side walls to guide the developing unit to be mounted on or removed from the mounting frame, and first and second supporting protrusions projected respectively from the first side wall and the second side wall of the mounting frame and supporting both sides of a front end portion of the developing unit, wherein the first and the second side walls respectively have a supporting unit contacting and supporting both sides of a back end portion of the developing unit;

a driving unit disposed on one side of the mounting frame; and the developing unit for mounting on the mounting frame and having a driven unit for engaging the driving unit, wherein the developing unit includes an interference unit that interferes with the mounting frame for shifting the developing unit in a transverse direction with respect to a mounting direction into engagement with the driving unit when the developing unit is mounted on the mounting frame.

7. The image forming apparatus of claim 6, wherein the supporting unit comprises a support slot formed in a mounting direction of the developing unit at an entrance portion of the first and the second side walls.

8. The image forming apparatus of claim 6, wherein the mounting frame further includes a front wall connecting the first and the second side walls.

9. The image forming apparatus of claim 6, wherein the developing unit comprises:

a developing unit main body having a supporting groove contacting the supporting protrusion when developing unit is mounted on the mounting frame to support the front end of the developing unit; and a photoconductor rotatably disposed in the developing unit main body and having ends defining a supporting shaft that is supported by the supporting unit of the side walls of the mounting frame, wherein the interference unit includes a first interference protrusion formed in a front portion of the supporting groove so as to contact the supporting protrusion when the developing unit main body is mounted in the frame, and a second interference protrusion formed close to the supporting shaft, the first interference protrusion causing the developing unit to move toward the driving unit when the developing unit is mounted on the mounting frame.

10. The image forming apparatus of claim 9, wherein the first interference protrusion is formed in a guide groove that guides the supporting protrusion to the supporting groove.

11. The image forming apparatus of claim 10, wherein the second interference protrusion extends from the developing main body at a distance greater than the first interference protrusion.

12. The image forming apparatus of claim 10, wherein a stepped portion is formed on one side wall facing the second interference protrusion at an entrance portion of the frame to interfere with the second interference protrusion.

13. The image forming apparatus of claim 12, wherein a gap groove is formed in one of the side walls of the frame to maintain a predetermined gap between the side wall and the second interference protrusion that interferes with the stepped portion.

14. The image forming apparatus of claim 6, wherein the driving unit includes a plurality of spaced apart driving gears inside the mounting frame, and the driven unit includes a plurality of driven gears to mesh with the driving gears, respectively when the developing unit is mounted on the mounting frame.

15. A developing unit for mounting to a mounting frame in an image forming apparatus, where the mounting frame has a driving unit for transferring a driving force to the developing unit, a supporting protrusion and a supporting unit for supporting the developing unit, the developing unit comprising:

a developing unit main body having a front side and an outer side surface with a supporting groove for contacting the supporting protrusion when the developing unit is mounted on the mounting frame to support the main body;

wherein the main body of the developing unit has a first and a second outwardly facing side surface, where each of said side surfaces have a supporting groove at a front end of said main body, and where an interference unit is provided on said first side surface opposite a driven unit to move the developing unit in a direction toward the driven unit;

a photoconductor rotatably disposed in the developing unit main body and having a supporting shaft with opposite ends supported by the supporting unit; and the driven unit disposed in the developing unit main body and meshing with the driving unit when the developing unit main body is mounted to the mounting frame, wherein one of side surfaces of the developing unit main body includes the interference unit that interferes with the mounting frame and to push the developing unit main body in a transverse direction with respect to a mounting direction into engagement with the driving unit when the developing main body is mounted on the mounting frame.

16. The developing unit of claim 15, wherein said interference unit comprises a first interference member positioned within the supporting groove on the first side surface.

17. The developing unit of claim 16, wherein said interference unit further comprises a second interference member on said first side surface at a back end of the main body.

18. An image forming apparatus comprising:

a mounting frame disposed in a main body of the image forming apparatus;

a driving unit disposed on one side of the mounting frame; and a developing unit for mounting on the mounting frame and having a driven unit for engaging the driving unit, wherein the developing unit includes an interference unit that interferes with the mounting frame for shifting the developing unit in a transverse direction with respect to a mounting direction into engagement with the driving unit when the developing unit is mounted on the mounting frame, wherein the interference unit is positioned on a first side of the developing unit and the driven unit is positioned on a second side of the developing unit opposite the first side, and where the interference unit moves the developing unit in a direction of the driven unit into engagement with the driving unit.

* * * * *